US008695147B2

(12) United States Patent
Felton, III

(10) Patent No.: US 8,695,147 B2
(45) Date of Patent: Apr. 15, 2014

(54) UNIVERSAL VELCRO® CLEANING TOOL

(76) Inventor: George Felton, III, Marana, AZ (US)

( * ) Notice: Subject to any disclaimer, the term of this patent is extended or adjusted under 35 U.S.C. 154(b) by 332 days.

(21) Appl. No.: 13/328,929

(22) Filed: Dec. 16, 2011

(65) Prior Publication Data

US 2013/0152318 A1 Jun. 20, 2013

(51) Int. Cl.
*A46B 9/06* (2006.01)

(52) U.S. Cl.
USPC ..... 15/106; 15/105; 15/104.001

(58) Field of Classification Search
CPC ..... B08B 1/00; A47L 25/00
USPC ..... 15/106, 105, 104.001, 104.002, 15/142–146
See application file for complete search history.

(56) References Cited

U.S. PATENT DOCUMENTS

| | | | | |
|---|---|---|---|---|
| 1,398,583 | A * | 11/1921 | Bovee | 132/103 |
| 5,018,542 | A * | 5/1991 | Lee | 132/139 |
| 6,701,566 | B2 * | 3/2004 | Rooke | 15/104.04 |
| 6,817,053 | B2 * | 11/2004 | Nakamura | 15/160 |

OTHER PUBLICATIONS

GripClean product information from manufacturer's website, fonora.com (1 pg).

* cited by examiner

*Primary Examiner* — Shay Karls
(74) *Attorney, Agent, or Firm* — Hayes Soloway P.C.

(57) ABSTRACT

Embodiments of the invention are directed to a device for cleaning VELCRO® comprising first and second rotating handle assemblies and a compound brush assembly comprising opposite first and second surfaces, the first surface comprising a stiff brush having metallic bristles, the second surface comprising a soft brush having non-metallic bristles. Rotation of the handles 180 degrees exposes the compound brush assembly for use.

20 Claims, 6 Drawing Sheets

UNIVERSAL VELCRO® CLEANING TOOL

BACKGROUND

1. Field of the Invention

The embodiments of the invention described herein are directed generally to a tool for cleaning and refurbishing hook-and-loop type fastener material such as VELCRO®. In particular, embodiments include a folding hand tool that may be unfolded to expose a two-sided wire and nylon brush combination for removing lint, dirt and other foreign materials that interfere with the loop-and-hook attachments.

2. Description of Related Art

VELCRO-type fasteners attract dirt, lint, fibers, hair, particulate matter, and other debris This accumulation of debris causes the fasteners to lose their adhesive properties, which deteriorates the uniform, equipment, gear, or other item constructed with VELCRO. Generally the deterioration of the VELCRO fasteners is the first step along the path to degradation of the overall item. To the best of the inventor's knowledge, there is only one other product on the market that addresses VELCRO cleaning. GRIPClean™ (Fonora Textile, Inc., Montreal, Quebec, Canada) cleans the hook side of the fasteners and provides no easy way to clean the brush therefore requiring that the brush be cleaned by hand. Thus, there are no known products on the market designed to clean both the hook and the loop sides of VELCRO fasteners.

SUMMARY OF THE INVENTION

An embodiment of the invention is directed to a device for cleaning VELCRO® comprising first and second rotating handle assemblies and a compound brush assembly comprising opposite surfaces, the first surface comprising a stiff brush having metallic bristles, the second surface comprising a soft brush having non-metallic bristles. Another embodiment of the invention includes the cleaning device wherein each handle assembly comprises a pair of substantially flat inner handle plates wherein their flat faces are parallel to each other when assembled, the inner handle plates having at least one hole at both ends; at least a pair of spacers disposed between said flat inner handle plates at a first and a second end, each spacer accommodating a pivot fastener within it, said pivot fastener being secured at both ends of said flat inner handle plates thereby securing the inner handle plates at a distance apart equal to the length of the spacer; and first and second handle covers attached to the exterior of said inner handle plates. The compound brush assembly may comprise a stiff brush assembly and a soft brush assembly. The stiff brush assembly may comprise metal bristles, preferably angular steel bristles. The soft brush assembly may comprise polymeric bristles, and the polymeric bristles are selected from the group consisting of nylon, polyester, and nylon-polyester blends. The compound brush assembly comprises a base portion having holes therethrough adapted to accommodate a pair of pivot fasteners.

Another embodiment of the invention is directed to a cleaning device wherein the compound brush assembly base is rotatably secured to said first and second rotating handle assemblies by a pair of pivot fasteners that penetrate the compound brush base holes and are secured to each inner handle plate.

Another embodiment of the invention is directed to a cleaning device wherein the compound brush base comprises a hard-stop interlock feature.

Another embodiment of the invention is directed to a cleaning device further comprising a retention clip. The retention clip is optimally affixed to the external face of one of the first and second rotating handle assemblies.

Another embodiment of the invention may comprise a pick tool.

Another embodiment of the invention may comprise a spring clip locking mechanism for releasably securing the free ends of the first and second rotating handle assemblies.

DETAILED DESCRIPTION OF EMBODIMENTS OF THE INVENTION

Figure 1:
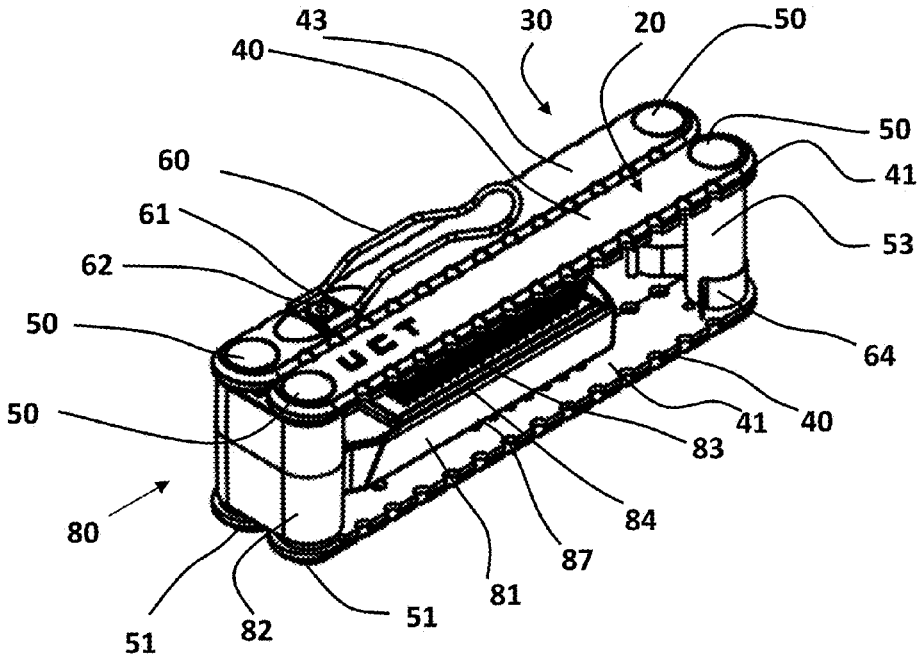
FIG. 1 is a perspective view of the invented multifunctional cleaning hand tool in a folded state for storage.
Figure 2:
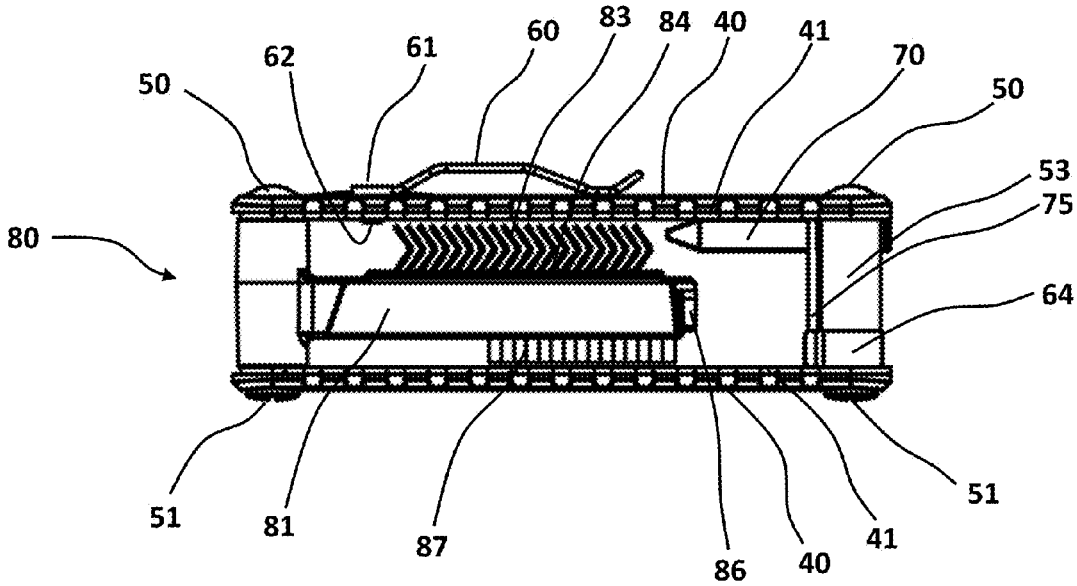
FIG. 2 is a right side view of the invented multifunctional cleaning hand tool in a folded state for storage.

The following examples are illustrations of the embodiments of the inventions discussed herein, and should not be applied so as to limit the appended claims in any manner.

An embodiment of the invention described herein is a device for cleaning VELCRO comprising first and second rotating handle assemblies 20, 30 respectively, a compound brush assembly 80 having a stiff brush assembly 81 having angled bristles on a first surface, and a soft brush assembly 86 having straight bristles on a second surface. In a preferred embodiment of the invention referencing the drawings shown in FIGS. 1-9, the device, called the Universal Cleaning Tool ("UCT"), is a multifunctional hand tool comprised of a two-part handle assembly comprising first and second handle covers 40 and 43, respectively, inner handle plates 41, a compound brush assembly 80, a pick tool 70, a retention clip 60, a spring clip locking mechanism 64, and four pivot fasteners each comprising first and second pivot fasteners 50 and 51, respectively.

With attention directed to FIG. 1, the handle of the tool is comprised of two separate halves 20, 30, of similar overall size and construction. Both halves of the handle are comprised of two parallel planes or inner handle plates 41 offset from one another. The space between these planes is occupied by the compound brush assembly 80, the pick tool 70, the pick tool locking mechanism 75, spacers 53, and a spring clip locking mechanism 64. The top and bottom planes of each handle half are comprised of two layers, the inner component, inner handle plate 41, is stamped from a metal, preferably steel, and the outer component, first and second covers 40 and 43, respectively, are molded from a durable polymeric material. Both components are of very similar outer profile and possess the same basic dimensions in width and length. The top and bottom planes of each handle half are constrained at each longitudinal end by first pivot fastener 50 and second pivot fastener 51 such that the two planes are at a fixed offset from each other and are unable to translate or rotate relative to one another. The offset between the two planes is dictated by the thickness of the compound brush assembly 80 at one end of the handle half and the combination of pick tool 70 and spacer 53 thickness is used to maintain the same separation distance at the opposite end.

The inner handle plates 41 are typically stamped from steel, de-burred and given a black oxide finish. The molded first and second covers 40 and 43 are formed with a beveled outer edge, reliefs for the first and second pivot fasteners 50 and 51 and the color can be chosen per application of the tool. Additionally, the long edges of the handle sections are beneficially formed with notches to provide improved grip during use and aid in the straightening and smoothing of hook and loop interfaces. The construction of the handle assembly layers is advantageously chosen and paired together to provide a rigid, robust, ergonomic, and esthetically pleasing chassis for the UCT.

The top and bottom sections of the handle halves encompass the compound brush assembly 80 and pick tool 70. First and second pivot fasteners 50, 51 are employed to join both stiff brush assembly 81 and pick tool 70 to the handles sections. Each pivot fastener is comprised of two interlocking halves, the first pivot fastener 50 possessing internal threading and the second pivot fastener 51, a matching external thread. The pivot fastener is made of steel and is of a design similar to a "Sex bolt" or a "Chicago bolt". Clamping force provided by the fastener can be adjusted by increasing or decreasing the thread engagement of the two halves. This allows the end user to change the effort needed to rotate the handles sections relative to the brush tool and the pick tool. A material selection of stainless steel or a black oxide finish applied to the pivot fasteners ensures corrosion resistance.

Figure 3:
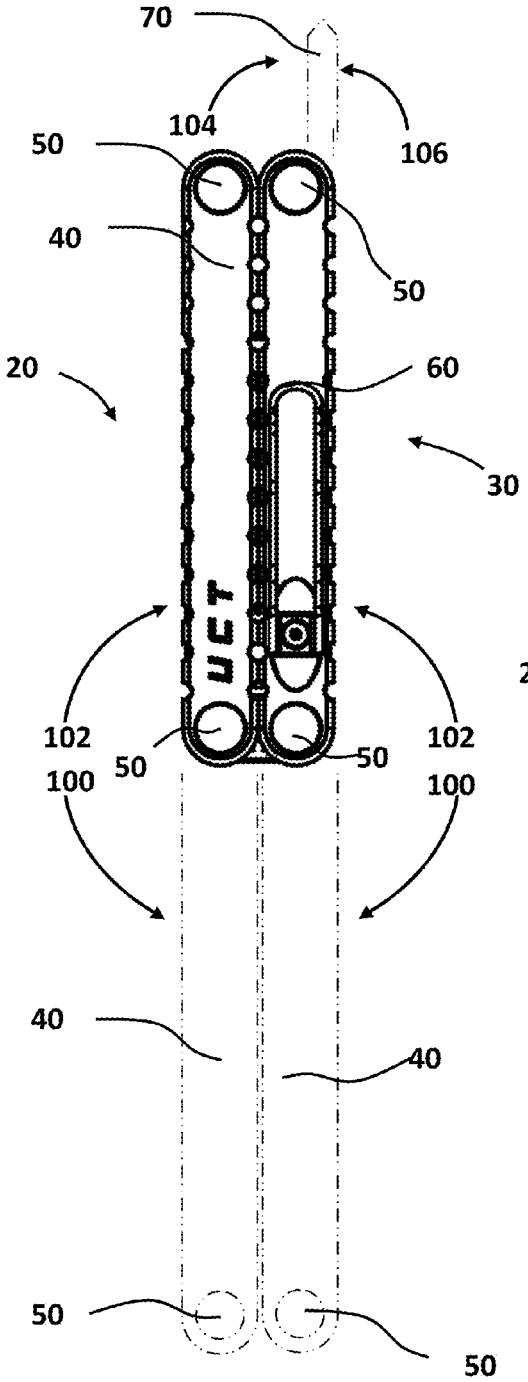
FIG. 3 is a top view of the invented multifunctional cleaning hand tool illustrating the motions performed to open or unfold the tool for use.
Figure 4:
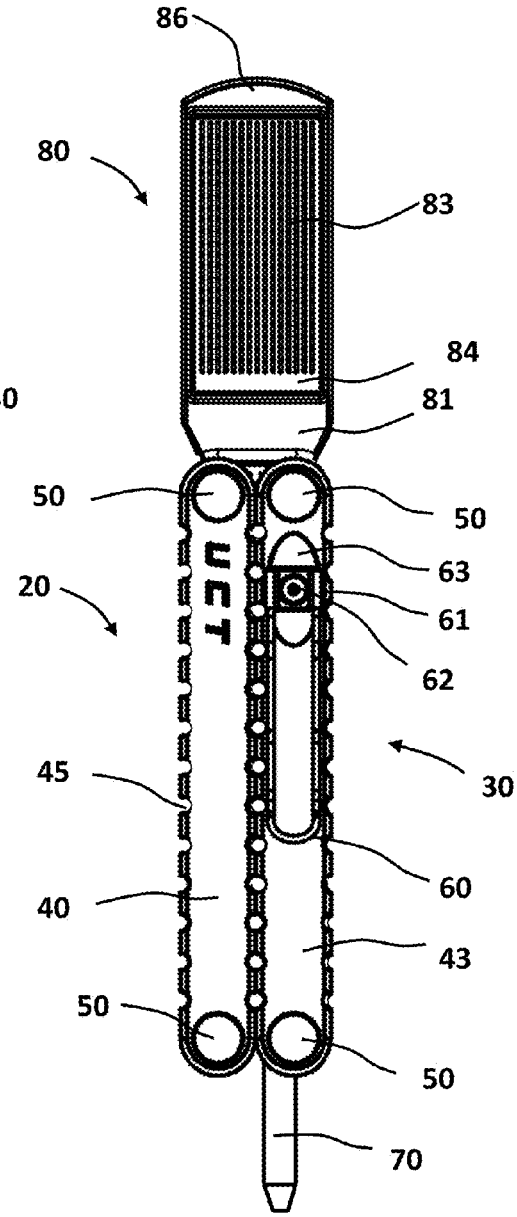
FIG. 4 is a top view of the invented multifunctional cleaning hand tool in an example of one possible unfolded configuration in which the tool is ready for use.
Figure 5:
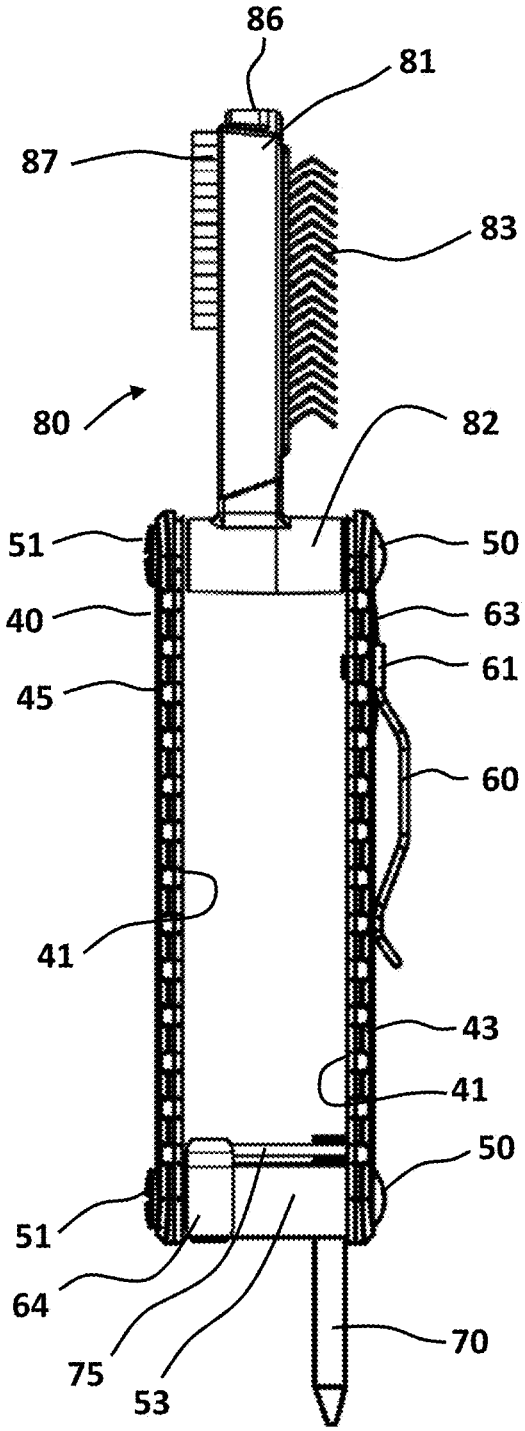
FIG. 5 is a right side view of the invented multifunctional cleaning hand tool in an example of one possible unfolded configuration in which the tool is ready for use.
Figure 6:
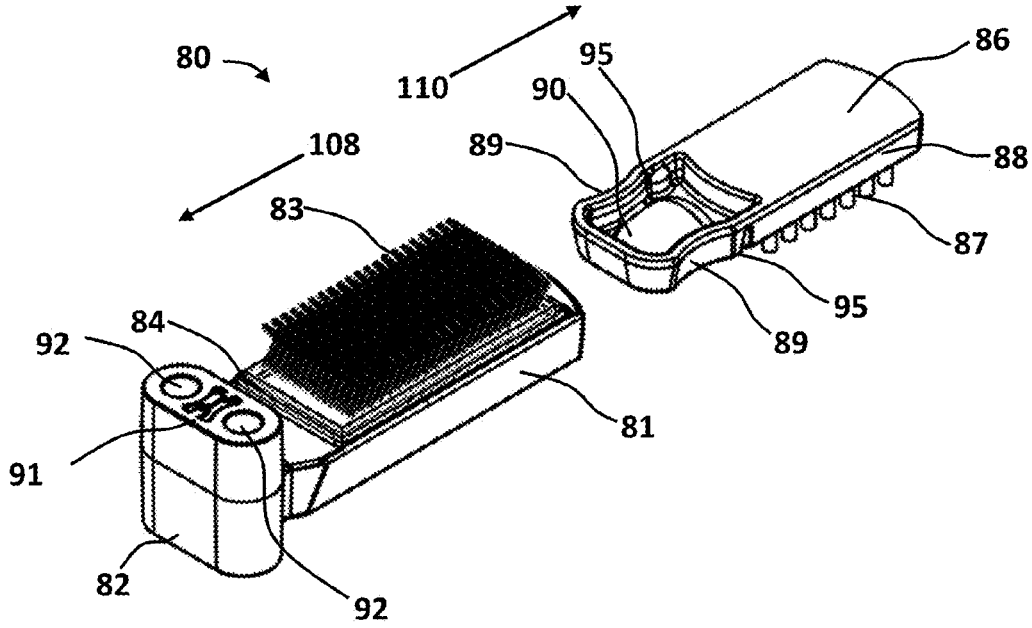
FIG. 6 is a perspective view depicting the construction of the compound brush head assembly.

The compound brush assembly 80 is pivotally attached through holes 92 in base 82 to the two handle halves using first and second pivot fasteners 50 and 51. Base 82 is dimensioned such that its height as shown in FIG. 6 is substantially equal to the length of the spacers 53 that retain the handle halves parallel and apart from each other a fixed distance. Starting with the UCT in a closed configuration as shown in FIG. 3, to utilize the compound brush assembly 80, the user rotates the handle halves about their pivot points in opposite and outward directions depicted by arrows 100 exposing the brush tool. The handles are rotated until the outer faces of the handle halves meet and become the encompassed inner faces between the two handle halves. This action exposes the compound brush assembly 80. Closing the tool involves an equal, but opposite action depicted by arrows 102.

Figure 9:
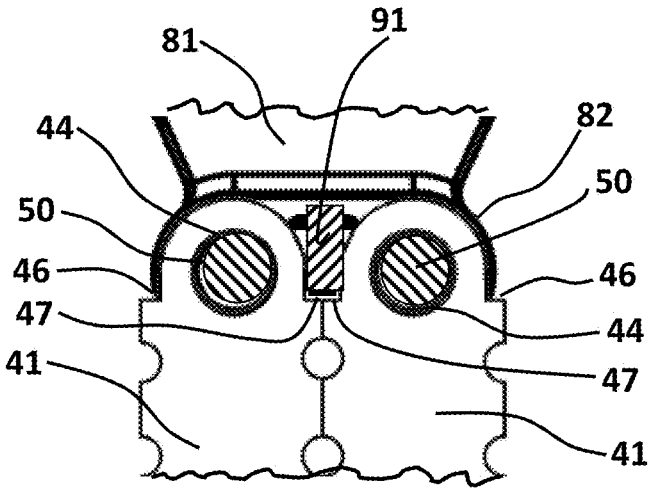
FIG. 9 is a section view depicting the mechanical interlock controlling the rotation of the compound brush head relative to handle sections.

Referencing FIG. 9, when the tool is in either a fully open or fully closed state, recesses 46 and 47 on the inner handle plates 41 of the handle halves engage a hard-stop interlock feature 91 molded on the compound brush assembly 80 which encourages an alignment between the handle halves and the compound brush assembly 80. This mechanism prevents collapse or movement of the compound brush assembly 80 during use by preventing any further rotation between the brush head and the handles by which the handle halves may move relative to one another in a longitudinal manner and the brush head may cease to be in line with the handle assembly.

Referencing FIG. 6, the compound brush assembly 80 is comprised of a stiff brush assembly 81 manufactured from steel or similarly rigid bristles 83 as well as a soft brush assembly 86 with more compliant polymer bristles 87, preferably nylon or the like. The base 82 of the compound brush assembly 80 serves as a base for the stiff brush assembly 81 and as a holder for the soft brush assembly 86. The soft brush assembly 86 affixes to the stiff brush assembly 81 assembly using a dovetail-style tenon and mortise joint. The soft nylon brush base is molded with tenon edges 88 which engage a mortise feature molded into the stiff brush assembly 81. Such an arrangement allows the soft brush to interlock with the film brush and remain firmly affixed unless translated longitudinally relative to one another 108 and 110. Furthermore, the soft brush assembly 86 features indents 95 molded into the sides of the brush which are engaged by detents molded into the stiff brush assembly 81. When the two brush assemblies 81 and 86 are joined together utilizing the tenon and mortise features, the detents engage the indents. This interlock resists longitudinal translation of the two brush assemblies relative to one another 108 and 110. This interlock can be overcome with sufficient force induced by the user, but prevents inadvertent separation of the brushes during storage. The material and geometry of the indent-detent interlock is advantageously designed to facilitate ease of use and robustness during repeated cycling.

The main portion of the compound brush assembly 80 is beneficially formed from a fiber reinforced polymer to ensure light weight and resistance to the forces exerted by the user while utilizing the stiff brush assembly 81. The stiff brush assembly 81 is formed by mounting the brush pad to the polymer base piece with epoxy or similar, rigid, permanent adhesive. The brush pad is made up of a flexible substrate 84 which contains a plurality of steel bristles 83. The soft brush assembly 86 is comprised of a similar fiber reinforced polymer base with clusters of nylon bristles 87 permanently inserted into preformed holes on the base. Additionally, the polymer base of the soft brush assembly 86 is formed with indentions 89, 90 on the sides (89) and adjacent to the bristles (90) to facilitate ergonomic handling and improved retention during use of the soft brush assembly 86.

Figure 7:
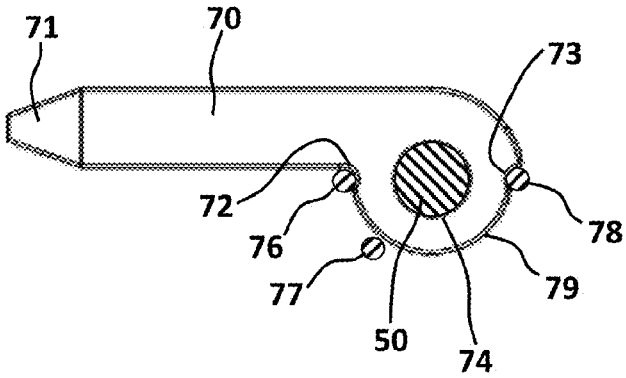
FIG. 7 is a section view depicting the pick tool and the mechanical interlock controlling the rotation of the pick tool during use.
Figure 8:
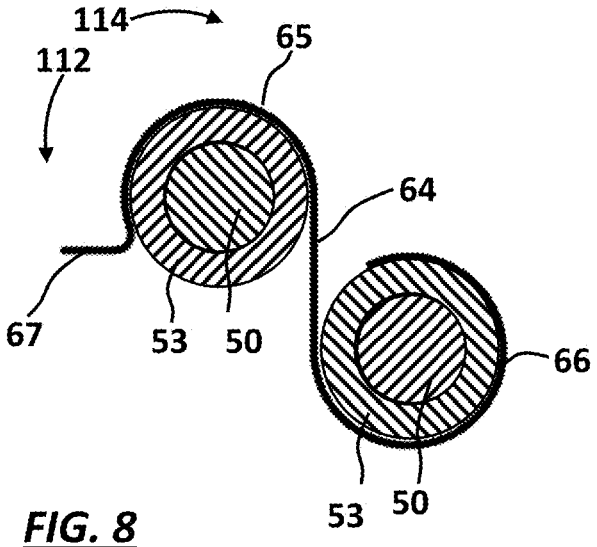
FIG. 8 is a section view depicting the retaining spring mechanism which controls the opening and closing of the handle sections of the invented tool.

With reference to FIG. 7, pick tool 70 consists of a short rod with a rectangular cross-section, a tapered point 71 at one end and a rounded section with a hole acting as a pivot point 74 at the other end. The pick tool is constructed from impacted or stamped aluminum to provide a light-weight, robust tool capable of resisting wear due to repeated service and not requiring a coating for corrosion resistance. The pick tool 70 can be used to clean the grooves of boots, as an accessory device to cleaning a uniform.

Pick tool 70 is allowed to rotate at its pivot point 74 about its respective first pivot fastener 50. Rotational motion of the pick tool is controlled in two manners. The first is the clamping force provided by the pivot fastener; increasing the clamping force increases the effort needed to rotate the tool. The second manner is a mechanical interlock provided by a pick tool locking mechanism 75 (see FIG. 2) which is, at its ends, constrained axially and radially between the top and bottom components of the handle. Referencing FIGS. 3 and 7, when the pick tool 70 is placed in the closed position 106, the dowel pin 76 engages an indent 72 on the pick tool 70. When the pick tool is opened 104, the dowel pin 76 is forced to yield in a non-plastic manner as it is pushed out of the indent 72 it normally rests in. While the pick tool 70 is being rotated from fully closed to fully open, the dowel pin 77 rests on the outer diameter of the pick tool pivot end 79 until the tool is rotated to the full open position where in the dowel pin 78 reaches a second indent 73 and returns to its non-stressed state. The material and forming properties of the dowel pin, along with the geometry of the indent and pin are advantageously chosen to provide appropriate rotation-resisting force while pick tool 70 is in the closed and open positions.

The spring clip locking mechanism 64 serves to prevent the two handle halves from rotating away from each other during use or storage of the UCT. Referencing FIG. 8, the spring clip locking mechanism 64 resembles the letter "s" in its basic form. The pivot end 66 of the spring clip locking mechanism 64 encompasses the nylon spacer 53 adjacent the pick tool 70 such that it can rotate as indicated by arrows 112 and 114 easily and freely about the spacer 53. To engage the locking mechanism once the two handle halves are in contact, the spring clip locking mechanism 64 is rotated in the direction indicated by arrow 112 about the spacer 53 at the pivot end 66 of the clip until the opposite end 65 of the spring clip locking mechanism 64 engages the spacer 53 of the adjacent handle half. To disengage the locking mechanism so that the handle halves can be separated an equal and opposite action takes place in the direction indicated by arrow 114. The end of the spring clip locking mechanism 64 which engages the spacer 53 of the opposing handle half encompasses approximately 220 degrees of the spacer 53, capturing the spacer. The spring clip locking mechanism 64 material and geometry is advantageously chosen to provide sufficient clamping force on the spacer of the opposing handle such that the user may easily engage and disengage the clip from the spacer to open and close the tool and such that the clip will not disengage while the tool is in use or in storage. Additionally, the spring clip is formed with a tab 67 to help facilitate use of the mechanism. The spring clip is produced using a method similar to flat springs using a steel alloy of resilient properties. The spacers are constructed of molded nylon to ensure minimal additional weight, reduced friction with engaging parts and sufficient resistance to the clamping loads exerted by the pivot fasteners.

The retention clip 60 serves as a storage device for UCT when the tool is not in use. The clip consists of a u-shaped loop formed from spring wire with its ends affixed to second handle cover 43 of the handle assembly. The ends are permanently captured in a retainer made from a stamped piece of steel that is crimped onto loop ends. The clip retainer 61 is then permanently affixed to the handle using a rivet fastener 62. Translation of the retention clip 60 is prevented by the rivet fastener. Rotation of the retention clip 60 is prevented by a mechanical orientation feature formed into second handle cover 43 which captures the clip retainer 61. The wire loop used for the retention clip acts as a spring and once installed acts against the handle plate providing a clamping force between the loop end of the clip and the handle. The material and geometry of the wire loop are designed to provide consistent and resilient clamping force to hold the UCT in place when being stored.

A description of certain factors that may be considered in the manufacture of the UCT will now be discussed. Although the tool itself is considered novel and unobvious, techniques of manufacturing portions of it are largely know to those of ordinary skill in the art. However, the following guidance regarding specific attributes of the invention will allow one of ordinary skill to make this particular embodiment of the invention.

Compound Brush Assembly—80:

Stiff Brush Base—81: wire brushes are known articles and methods of construction are known to those of ordinary skill in the wire brush art. However, this part may be injection molded using a fiber-reinforced thermoplastic polymer ("FRP"). This material demonstrates a high level of toughness and is ideal in the UCT application due to its favorable weight and ease of manufacture as compared to a similar metal component. With proper design, this part should demonstrate similar mechanical properties to metal. There are several options for the fiber material (carbon, aramid, glass). Due to the intended use of the tool in military and law enforcement, extreme environmental conditions should be anticipated when selecting the type of FRP to use (UV exposure resulting in degradation, extreme temperatures resulting in an increase of brittle behavior, etc). An especially preferred material is Carbon fiber.

Consideration must also be given to select a FRP that can be robustly used in the indent-detent interlock system which holds the soft brush assembly 86 in the compound brush assembly 80 during storage as well as the handle hard-stop feature near the handle pivot points. If a suitable and robust FRP cannot be found for these two features, an over molded design may be necessary whereby metal components of steel or brass are molded into the FRP brush base in these locations.

The finished item must be free of manufacturing contamination and plasticizers in order for the flexible substrate/wire pad 84 adhesive to properly bond. Parts may need to be subjected to a secondary cleaning operation if this cleanliness condition cannot be met.

Soft Brush—86: Nylon brushes are known articles and methods of construction are known to those of ordinary skill in the nylon brush art. However, this part can be injection molded using a fiber-reinforced thermoplastic polymer. The reasoning behind this material selection is similar to that of the wire brush base described prior. The brush bristles can be inserted into preformed holes in the FRP base. Generally, a cluster of bristles can be inserted with high force and may even be staked in place with a staple like fastener which bites into the parent material of the base. While likely increasing the cost, it may also be possible to over mold the bristle clusters during the injection molding process.

Flexible substrate/Wire Pad—84: the wire pad can be purchased as a commercially available item and should be able to be ordered pre-cut to the dimensions needed for application to the wire brush base. Carolina Brush Company, Gastonia, N. Carolina, is one commercial source for the wire pad. A permanent adhesive with mechanical and durability properties consistent with the intended use of the UCT can be used to affix the brush pad to the base. The metal used for the wire bristles may be stainless steel to prevent corrosion under extreme conditions seen during use. A typical pad size is 0.80 inch by 1.75 inches containing bent steel bristles, although modifications of these measurements will not affect the performance of the product.

Retention Clip Assembly—60 & 61:

Clip Retainer—61: clip retainer 61 can be stamped from mild steel sheet stock. This method of manufacture is low cost and requires minimal tooling. The surface quality of the part need to be specified to avoid assembly difficulty (part should be clean for the brazing of the wire loop). Since this part is contacted by the end user, it must also be free of sharp edges resulting from the stamping or brazing operations.

Retention Clip—60: the wire loop will act as a spring in this application and must apply a constant force against the tool handle despite repeated cycling of the clip when storing or deploying the tool. The loop can be formed in a similar many other wire spring components. The material selection is very important to ensure resilient behavior of the clip. Spring steel of a medium carbon, low alloy composition is ideal. As with the retainer plate, the wire clip must be clean after manufacture as to not negatively impact the secondary brazing operation affixing the retention clip to the clip retainer.

Because the retention clip assembly is steel, corrosion is a possibility. The assembly may be coated to negate this. A black oxide finish is ideal in this situation. It will resist environmental factors, remains flexible as the clip is deflected, and will not wear off after repeated contact.

Inner Handle Plate—41: the handles may preferably be stamped from steel sheet stock, although aluminum, titanium and similar metals are interchangeable except for cost. Steel will provide a sufficiently sturdy chassis for the handle assembly. All geometry present on the current part design including the edge notches and the brush head interlock can be incorporated into the stamping process requiring no secondary forming processes to yield a usable part. The parts may need to be de-burred after the stamping operation depending on the quality of the stamping tool and the type of steel used for the plate. The part must be free of sharp edges and burrs as it will be contacted by the end user.

The part may be prone to corrosion based on the selection of steel for its construction. A black oxide coating maybe used for the same reasons listed for the retention clip assembly.

First and Second Handle Covers—40 & 43: the handle covers may preferably be injection molded with a thermoplastic polymer. Injection molding affords high part yield and low piece cost compared with other methods. There are several material selections possible with is process including ABS, Nylon, and Polypropylene. Due to the intended use of the tool in military and law enforcement, environmental conditions should be considered when selecting the type of thermoplastic polymer. The material must withstand UV exposure and temperature extremes. It must also resist wear or deformation resulting from repeated abuse during its service life.

First and Second Pivot Fasteners—50 & 51: the pivot fasteners are a commercially available component consisting of a screw and a barrel nut. These are also known as "sex bolts" or "Chicago-bolts" or "Chicago screws". No special manufacturing arrangements need to be made for these components. Consideration of material, finish, head profile, screw drive type, and retention techniques must be taken. Stainless steel will resist corrosion, but is generally of a much higher piece cost than carbon steels. Carbon steel can be used if it is zinc plated or black oxide finished. The head profile of both sections of the fastener needs to be of a size that will not exceed the recess diameter of the handle covers and which will not protrude to a degree that it detracts from the ease of use of the tool. Low profile designs like a pan head or truss head are ideal. The screw drive type must be one that supports end-user adjustability and field serviceability with common tools. Slot, Philips, Hex socket, or Torx are suggested. Repeated use of the UCT may result in the pivot fasteners disengaging over time. Screw retention techniques may be considered to reduce this possibility. Knurling under the screw head or thread lockers are common methods of controlling this. Chicago bolts are available from any number of suppliers, including Lee Valley Tools, Ogdensburg, N.Y. (www.leevalley.com).

The fasteners should be free of oil or contamination that may hamper tool use or increase the likelihood of the fasteners disengaging during use.

Spacers—53: The spacers 53 can be extruded from a thermoset polymer. Nylon is a common material for this type of part and commercially available solutions may exist. Flatness of this part should be treated as critical to avoid misalignment of the handle components; this is often difficult to control in commercially available parts. Due to the intended use of the tool in military and law enforcement, environmental conditions should be considered when selecting the type of thermoplastic polymer. The material must withstand UV exposure and temperature extremes. It must also resist wear or deformation resulting from repeated abuse during its service life. A currently preferred material includes an impregnated material such as DELRIN™ with graphite may provide better wear characteristics by providing a more slippery bearing surface between the spacers and the parts that contact them.

Pick Tool—70: this part can be produced with a stamping or impacting process performed on steel or aluminum. Producing this part from aluminum using an impacting process, should yield a strong, light weight tool requiring no secondary forming operations. Alternatively, the part may be extruded from aluminum as a long rod with a cross-section matching the profile of the part and then cut into segments at a secondary operation. Care must be taken to make sure the part has no artifacts of the manufacturing process in either instance that detracts from its usefulness. Aluminum as a material choice will negate the need for any further coating or finished to prevent corrosion, but hard anodizing may be employed for esthetics.

Dowel Pin—76: since this part functions as a spring in this application, material choice is important to ensure resilient behavior throughout the useful life of the tool. Spring steel of a medium carbon, low alloy composition is preferred. Wire is readily available in this material and forming would consist of parting the wire into segments of the desired length. Commercially available solutions may exist. A black oxide coating is ideal for the same reasons listed for the retention clip assembly.

The cleaning tool is utilized in the following manner. VELCRO® is made from two opposite surfaces, the hook surface, and the loop surface. First, the user opens the tool so that the stiff (hard wire) brush head is exposed and usable. The user brushes or strokes the wire bristles lengthwise along the hook side of the fasteners and removes the debris. Next the user removes the soft (nylon) brush to clean the loop side of the fastener in the same manner noted above for the hook side. The user then uses the nylon brush to clean the removed debris from the hard wire brush and can next remove the debris from the nylon brush by hand. The nylon brush is then replaced onto the tool and the tool is closed. In the closed position, the UCT is used to flatten, straighten, and align the fasteners to create a more effective adhesion and cleaner appearance.

EXAMPLE

Practical Comparison Between the GRIPClean™ Brush and the UCT

A practical comparison between the GRIPClean brush and the UCT was conducted to determine which tool performed better. In a study of direct comparison, both cleaning devices were used to clean the hook portion of hook and loop (VELCRO®) fasteners that had accumulated fiber, pet hair, and other debris. It is important to note that the GRIPClean was not designed to clean the soft loop side portion of hook and loop fasteners, as acknowledged in its instructions for use. Therefore, no practical comparison between the GRIPClean and the UCT could be conducted to determine the effectiveness of cleaning the soft loop side of the material.

Figure 10:
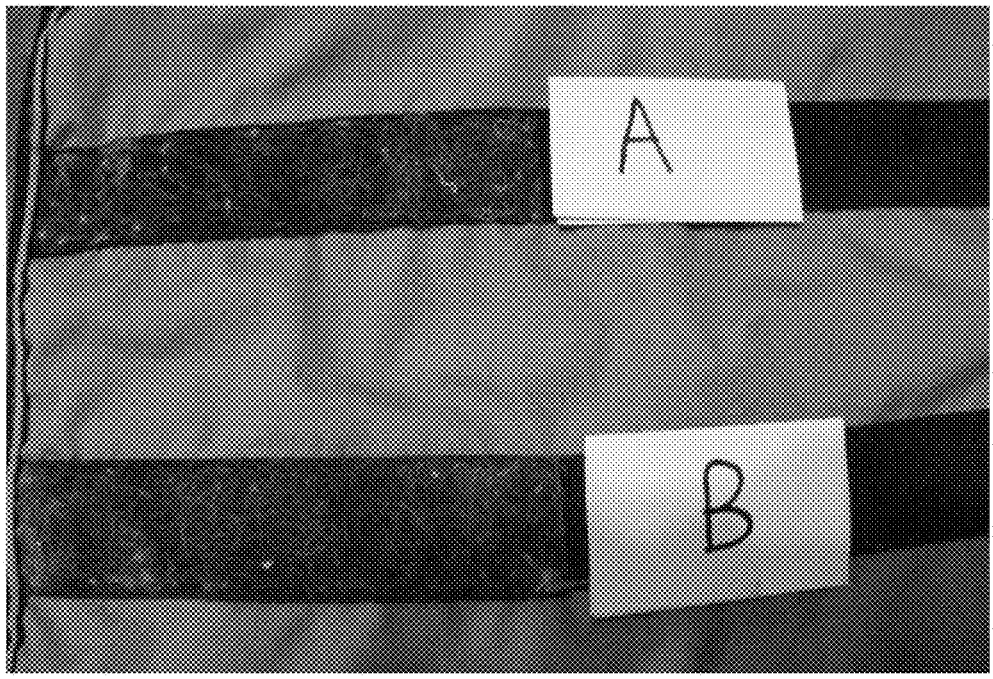
FIG. 10 is a photograph of the VELCRO tapes' hook-side fasteners. A and B are identical, and are dirtied from normal wear-and-tear.
Figure 11:
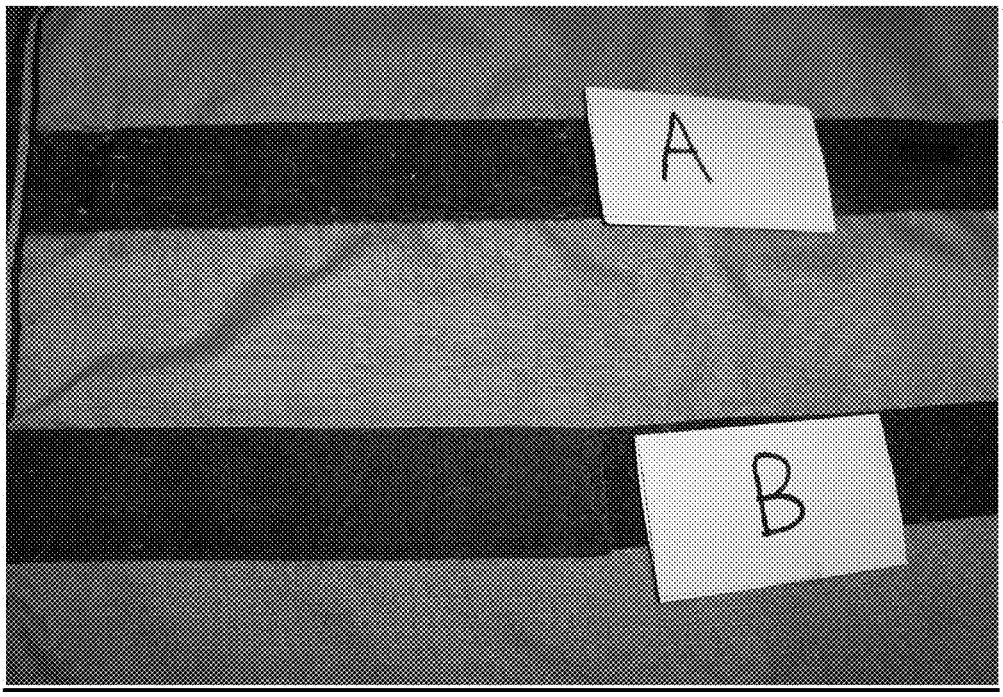
FIG. 11 is a photograph of the same VELCRO tape samples as in FIG. 10, but sample A has been brush-cleaned with the GripClean tool, and sample B cleaned with an embodiment of the UCT invention described herein.

The following cleaning procedure was carried out. Two VELCRO strips of approximately 2" width and 8.25" length were prepared by being sewn to the fabric by the manufacturer and being exposed to everyday normal dirt, hair, and other debris during regular usage became dirty (FIG. 10A, B). The GRIPClean was oriented horizontally and ten (10) strokes of moderate pressure were applied to the VELCRO labeled "A". After completing the strokes with the GRIPClean, the fastener side was approximately 60% clean (free of debris). That is, a little more than half of the debris was removed, as judged by comparison of the before (FIG. 10, A) and after (FIG. 11, A) pictures. This same process was conducted using the UCT on sample B. The UCT was oriented horizontally and ten (10) strokes of moderate pressure were applied to the material labeled sample B. After completing the strokes with the UCT, the fastener side was approximately 90% clean (free of debris), that is only a small amount of debris was left (see FIGS. 11, A, B).

This process was repeated with both devices three (3) times with similar results. Each time the UCT was surprisingly more effective than the GRIPClean. That is, using the same number of manipulations and the same pressure, the UCT greatly outperformed the GRIPClean in its ability to remove hair and debris from the hard side of the fasteners.

Additional comparisons of the two products reveal the following: The UCT's design and inclusion of a soft, polymeric brush solves the problem of cleaning the soft loop side of hook and loop fasteners. Although loop-side cleaning was not tested in a comparative manner, the GRIPClean is not designed for the loop sides and cannot clean that side.

After usage, both the GRIPClean and the UCT bristles retained the debris removed from the hook side fasteners. An attempt to clean the debris from the GRIPClean by hand resulted in the bristles painfully sticking in the user's fingers. However, the hard wire (hook cleaning) bristles of the UCT can be cleaned by using the soft nylon type bristles of the soft side (loop cleaning) brush. This effectively cleans the hard bristles without discomfort/pain to the user. The GRIPClean does not provide any method to clean its bristles and cleaning it by hand is uncomfortable and even painful.

The UCT also enables the user to iron/flatten/straighten both sides of the fasteners, which makes the sides stick together and better adhere. After the fasteners are cleaned with the UCT in the closed position, the side of the UTC handle provides a hard and straight edge for "ironing" the sides together. When the GRIPClean was used in an attempt to iron the sides together, the rubber grips of the handle crumbled and stuck to the fabric surrounding the fasteners, making this fabric dirtier than it originally was. The UCT ironed the fasteners together, made them more secure, and provided a neater and cleaner appearance than it originally was.

Overall, the UCT is a surprisingly more effective hook and loop fastener cleaning device. It outperforms the GRIPClean in several ways, including effectiveness of cleaning both sides of the fastener material, cleaning itself, and is more durable and versatile.

It will be understood that various modifications may be made to the embodiments disclosed herein. Therefore, the above description should not be construed as limiting, but merely as exemplifications of preferred embodiments. Those skilled in the art will envision other modifications that come within the scope and spirit of the claims appended hereto. All patents and references cited herein are explicitly incorporated by reference in their entirety.

| Parts List | |
|---|---|
| 20 | first rotating handle assembly |
| 30 | second rotating handle assembly |
| 40 | first handle cover |
| 41 | inner handle plate |
| 43 | second handle cover |
| 46 | recesses |
| 47 | recesses |
| 50 | first pivot fastener |
| 51 | second pivot fastener |
| 53 | nylon spacer |
| 60 | retention clip |
| 61 | clip retainer |
| 62 | rivet fastener |
| 64 | spring clip locking mechanism |
| 65 | end |
| 66 | pivot end |
| 67 | tab |
| 70 | pick tool |
| 71 | tapered point |
| 72 | indent |
| 73 | second indent |
| 74 | pivot point |
| 75 | pick tool locking mechanism |
| 76 | dowel pin |
| 77 | dowel pin |
| 78 | dowel pin |
| 79 | pick tool pivot end |
| 80 | compound brush assembly |
| 81 | stiff brush assembly |
| 82 | base |
| 83 | rigid bristles |
| 84 | flexible substrate/wire pad |
| 86 | soft brush assembly |
| 87 | compliant polymer bristles |
| 88 | tenon edges |
| 89 | sides |
| 90 | bristles |
| 91 | hard-stop interlock feature |
| 92 | holes |
| 95 | features indents |
| 100 | directional arrows |
| 102 | directional arrow |
| 106 | closed position |
| 112 | directional arrow |
| 114 | directional arrow |

I claim:

1. A device for cleaning VELCRO® comprising:

first and second rotating handle assemblies, each handle assembly comprising a pair of substantially flat inner handle plates wherein their flat faces are parallel to each other when assembled, the inner handle plates each having a first end and a second end and at least one hole at both ends; and a compound brush assembly comprising first and second opposing surfaces, the first surface comprising a stiff brush comprising metallic bristles, the second surface comprising a soft brush comprising non-metallic bristles.

2. The cleaning device of claim 1 wherein each handle assembly further comprises at least a pair of spacers disposed between said flat inner handle plates at said first and said second ends, each spacer accommodating a pivot fastener within it, said pivot fastener being secured at both ends of said flat inner handle plates thereby securing the inner handle plates at a distance apart equal to the length of the spacer; and first and second handle covers attached to the exterior of said inner handle plates.

3. The cleaning device of claim 1 wherein the compound brush assembly comprises a stiff brush assembly and a soft brush assembly.

4. The cleaning device of claim 3 wherein the stiff brush assembly comprises metal bristles.

5. The cleaning device of claim 4 wherein the stiff brush assembly comprises angular steel bristles.

6. The cleaning device of claim 3 wherein the soft brush assembly comprises polymeric bristles.

7. The cleaning device of claim 6 wherein the polymeric bristles are selected from the group consisting of nylon, polyester, and nylon-polyester blends.

8. The cleaning device of claim 1 further comprising a pick tool.

9. The cleaning device of claim 1 wherein said compound brush assembly comprises a base portion having holes therethrough adapted to accommodate a pair of pivot fasteners.

10. The cleaning device of claim 1 further comprising a spring clip locking mechanism for releasably securing a free end of the first rotating handle assembly to a free end of the second rotating handle assembly.

11. The cleaning device of claim 9 wherein said compound brush assembly base is rotatably secured to said first and second rotating handle assemblies by a pair of pivot fasteners that penetrate the compound brush base holes and are secured to each inner handle plate.

12. The cleaning device of claim 1 wherein the compound brush base comprises a hard-stop interlock feature.

13. The cleaning device of claim 1 further comprising a retention clip.

14. The cleaning device of claim 13 wherein the retention clip is affixed to the external face of one of the first and second rotating handle assemblies.

15. A device for cleaning VELCRO® comprising:

first and second rotating handle assemblies, each handle assembly comprising a pair of substantially flat inner handle plates wherein their flat faces are parallel to each other when assembled, the inner handle plates having at least one hole at both ends;

at least a pair of spacers disposed between said flat inner handle plates at a first and a second end, each spacer accommodating a pivot fastener within it, said pivot fastener being secured at both ends of said flat inner handle plates thereby securing the inner handle plates at a distance apart equal to the length of the spacer;

first and second handle covers attached to the exterior of said inner handle plates;

a compound brush assembly comprising first and second opposing surfaces, the first surface comprising a stiff brush comprising metallic bristles, the second surface comprising a soft brush comprising non-metallic bristles; and a pick tool located opposite said compound brush assembly and rotating from a first internal position to a second exposed position.

16. The cleaning device of claim 15 wherein the stiff brush assembly comprises angular steel bristles.

17. The cleaning device of claim 15 wherein the soft brush assembly comprises polymeric bristles.

18. The cleaning device of claim 15 wherein said compound brush assembly is rotatably secured to said first and second rotating handle assemblies by a pair of pivot fasteners that penetrate the compound brush assembly and are secured to each inner handle plate.

19. The cleaning device of claim 15 wherein the compound brush assembly comprises a hard-stop interlock feature.

20. The cleaning device of claim 15 further comprising a retention clip.

* * * * *